United States Patent [19]

Merrick et al.

[11] 4,127,410

[45] Nov. 28, 1978

[54] NICKEL BASED ALLOY

[75] Inventors: Howard F. Merrick, Suffern; LeRoy R. Curwick, Warwick, both of N.Y.

[73] Assignee: The International Nickel Company, Inc., New York, N.Y.

[21] Appl. No.: 742,096

[22] Filed: Nov. 16, 1976

Related U.S. Application Data

[63] Continuation-in-part of Ser. No. 669,824, Mar. 24, 1976, abandoned.

[51] Int. Cl.[2] ..... C22C 19/05

[52] U.S. Cl. ..... 75/171; 148/32.5; 148/162

[58] Field of Search ..... 75/171, 170; 148/32, 148/32.5, 162

[56] References Cited

U.S. PATENT DOCUMENTS 3,869,284 3/1975 Baldwin ..... 75/171

*Primary Examiner*—R. Dean

*Attorney, Agent, or Firm*—Raymond J. Kenny; Ewan C. MacQueen

[57] ABSTRACT

Nickel-base alloy containing chromium, aluminum, titanium and molybdenum, and desirably including cobalt and metal from group tungsten and tantalum, has combination of strength and ductility at elevated temperatures, particularly including stress-rupture strength at 1800° F. and ductility at 1400° F., along with resistance against oxidation and to hot corrosion by combustion products from jet propulsion fuels. Alloy is especially useful in production of gas turbine rotor blade castings.

5 Claims, No Drawings

NICKEL BASED ALLOY

This application is a continuation-in-part of application Ser. No. 669,824, filed Mar. 24, 1976, abandoned.

The present invention relates to nickel-base alloys and more particularly to nickel-base alloys having heat and corrosion resistant characteristics desired for gas turbine components, for instance, turbine rotor blades.

Gas turbine engines and utility thereof for powering aircraft and other vehicles or stationary machines are, in general, well known, as also are many needs for materials that will provide strength and corrosion resistance during exposure to heat and corrosive attack from turbine fuel combustion. Some of the more important characteristics needed for gas turbine components such as turbine rotor blades include strength and ductility at elevated temperatures, particularly stress-rupture strength at high elevated temperatures such as 1800° F. and elongation at intermediate temperatures of around 1400° F., where the 1400° F. ductility trough is sometimes a detriment, along with resistance to corrosion in kerosene fuel(JP) combustion atmospheres containing sulfur and chlorides. Oxidation resistance, especially at very high temperatures of about 2000° F., is also needed. Furthermore, desired characteristics include metallurgical stability and the ductility characteristic of reduction-in-area at short-time tensile test fracture at intermediate temperatures, which is considered an indicator of resistance of the alloy to thermal fatigue.

There has now been discovered an alloy that provides an especially good combination of strength and corrosion resistance at elevated temperatures.

Another object of the invention is to provide metal articles having strength, ductility and corrosion resistance in fossil fuel combustion atmospheres.

The present invention contemplates a nickel-base alloy containing, by weight, 11.5% to 16% chromium and 1.5% to 5% metal from the group tantalum and tungsten and mixtures thereof provided that the amount of any tungsten does not exceed 3% and further provided that the amounts of chromium and any tantalum and tungsten are in proportions in accordance with the Cr-Ta-W relationship $$\%\,Cr+\tfrac{1}{3}(\%Ta+\%W)=13.5\%\text{ to }17.5\%,$$

4.3% to about 5% aluminum and 4% to about 5% titanium provided the sum of the aluminum and titanium is at least 8.5%, 4% to 10% cobalt, 2% to 4% molybdenum, up to 0.2% carbon, up to 0.4% boron, up to 0.2% zirconium and balance essentially nickel in an amount of at least about 55%. It is also possible to have embodiments without either tungsten or tantalum and in this respect the possible proportions of these elements can be referred to as being up to 5% metal from the group tantalum and tungsten and mixtures therof with the aforestated provisos. Still, presence of at least 1.5% of one or both of the metals tantalum and tungsten, e.g., 4.5% tantalum or 2% tungsten, is recommended for ensuring desirable sulfidation resistant and strength characteristics. It is further contemplated that satisfactory results can be obtained with some embodiments containing cobalt in amounts less than 4%, e.g., 2% cobalt, or possibly without cobalt.

Presence of about 0.02% or more carbon, desirably 0.08% to 0.2% carbon, together with about 0.01% to 0.02% boron and 0.06% to 0.1% zirconium is advantageous for promoting high temperature strength and ductility. Further, it is understood that higher boron levels, such as 0.15% to 0.3% boron, together with lower carbon levels, e.g., 0.02% to 0.05% carbon, may be beneficial in promoting further improvements in high temperature ductility and also in castability.

It is contemplated that the composition will tolerate up to 2% hafnium, if desired. Yet, the present alloy has shown good castability and other good results, including strength, ductility and corrosion resistance, without hafnium.

Advantageous controls for obtaining desired combinations of strength, ductility, metallurgical stability and resistance to oxidation and other corrosion, e.g., sulfidation, include controlling chromium to the range of 13.5% to 15.5%, aluminum and titanium to the range of 8.5% to 9.5% aluminum-plus-titanium, cobalt to not exceed 8%, desirably 4% to 7% cobalt, carbon to the range of 0.08% to 0.20% carbon, and tungsten to the range of 1.5% to 3% tungsten when present without or with no more than ½% tantalum, or 2% to 5% tantalum when present without or with no more than ½% tungsten. When including mixtures with tungsten up to 3% and tantalum up to 5% the total of the percent tungsten plus two-thirds the percent of tantalum is desirably 1.5 to 3. Boron and zirconium can be in ranges of about 0.1% to about 0.02% boron and about 0.05% to about 0.15% zirconium.

For the present invention, iron and columbium are considered undesirable impurities and are maintained as low as is commercially practical, for instance, not more than 1% iron and not more than 1% columbium, desirably not exceeding 0.5% in total. Molybdenum, tungsten, and tantalum are not substitutional equivalents for each other in the alloy of the invention and these elements should be controlled according to the ranges and proportions specified for each herein. Sulfur, phosphorus and other elements known to be detrimental to nickel-based heat resistant alloys should be avoided or controlled to lowest practical levels.

Castings of the alloy are advantageously prepared by vacuum-induction melting and vacuum casting into ceramic shell molds. Heat treatment of the as-cast alloy with treatments of about 1 to 3 hours at about 2100° F. to 2000° F., air cooling, and then for about 20 to 30 hours at about 1600° F. to 1500° F., e.g., 2 hours at 2050° F. plus 24 hours at 1550° F., has been found beneficial to corrosion resistance and mechanical properties and is herein recommended for providing advantageous embodiments of the invention. The heat treatment provides a duplex, large and small size, gamma-prime structure in a gamma matrix and discrete (globular, nonfilm-like) chrome-carbides of the $Cr_{23}C_6$ type as the casting grain boundaries. The heat treatment does not change the grain size of the casting.

Particularly good combinations of strength, ductility and corrosion resistance are obtainable with heat treated castings of compositions provided by the invention including, inter alia, a tungsten-containing nickel-base alloy composed of about 2% tungsten, about 14% chromium, about 6% cobalt, about 3% molybdenum, about 4.5% aluminum, about 4.5% titanium, about 0.15% carbon, about 0.015% to 0.02% boron, about 0.06% to 0.1% zirconium and balance essentially nickel, and also with a tantalum-containing nickel-base alloy containing about 4.5% tantalum, about 14% chromium, about 6% cobalt, about 3% molybdenum, about 4.5% aluminum, about 4.5% titanium, about 0.15% carbon, about 0.015% to 0.02% boron, about 0.06% to 0.1% zirconium and balance essentially nickel.

For providing those skilled in the art a further understanding of the invention, the following examples are given.

EXAMPLE I

An alloy melt was prepared by vacuum-induction melting virgin raw materials, e.g., nickel pellets (spherical), cobalt rondells and titanium sponge, in proportions of about 14% chromium, 6% cobalt, 3% molybdenum, 2% tungsten, 4.5% aluminum, 4.5% titanium and balance (66%) nickel, plus additions of about 0.15% carbon and about 0.02% boron as graphite rod and a nickel-17% boron prealloy, and then casting the melt, while in vacuum, into an ingot mold, thereby providing a master alloy ingot of alloy 1. The master alloy ingot was analyzed and vacuum-induction remelted with a 0.3% chromium addition and the remelt was vacuum cast into 1800° F. preheated, cobalt-oxide inoculated, ceramic shell molds. Results of chemical analyses, mechanical property testing and also of elevated temperature oxidation and combustion-flame testing of castings from the remelt are set forth in the following Tables I and II. Grain sizes in test sections of tensile and stress-rupture bars, without and with heat treatment, were about 1/16 to ⅛ inch.

EXAMPLES II–VI

Alloys 2, 3, 4, 5 and 6 were vacuum-induction melted, remelted and cast, and analyzed and tested, according to the practices of Example I. Remelt additions did not exceed 1% chromium and 0.2% titanium. Results pertaining to alloys 2–6 are set forth in the following Tables I and II.

TABLE I

| Alloy No. | CHEMICAL ANALYSES, WEIGHT PERCENT | | | | | | | | | | |
|---|---|---|---|---|---|---|---|---|---|---|---|
| | C | Cr | Co | Mo | W | Al | Ti | Ta | B | Zr | Ni |
| 1 | 0.16 | 13.8 | 6.0 | 3.0 | 2 | 4.6 | 4.7 | NA | 0.016 | 0.09 | Bal. |
| 2 | 0.17 | 11.9 | 6.4 | 2.9 | NA | 4.6 | 4.0 | 4.4 | 0.016 | 0.08 | Bal. |
| 3 | 0.19 | 14.5 | 6.1 | 3.1 | NA | 4.9 | 5.0 | NA | 0.016 | 0.08 | Bal. |
| 4 | 0.17 | 14.0 | 6.1 | 3.0 | NA | 4.4 | 4.8 | 1.8 | 0.019 | 0.08 | Bal. |
| 5 | 0.18 | 13.8 | 6.1 | 2.9 | NA | 4.6 | 4.1 | 4.1 | 0.02 | 0.09 | Bal. |
| 6 | 0.16 | 13.6 | 5.9 | 2.9 | NA | 4.3 | 4.3 | 4.5 | 0.02 | 0.06 | Bal. |

NA - Not added and not analyzed
Bal. - Balance

TABLE II

| Alloy | | Stress Rupture Properties | | | | | | 1400° F Short-Time Tensile | | | | 2000° F Oxidation | 1700° F Corrosion | Room Temp. |
|---|---|---|---|---|---|---|---|---|---|---|---|---|---|---|
| | | 1800°F/29 ksi | | | 1400° F/94 ksi | | | | | | | | | |
| No. | Cond. | Life | % El | % RA | Life | % El | % RA | .2% YS | UTS | % El | % RA | Loss | Penetration | Hard. |
| | | (Hr) | | | (Hr) | | | (ksi) | (ksi) | | | ($Mg/cm^2$) | (mil) | (Rc) |
| 1 | H.T. | 31.7 | 6.7 | 11.9 | 83.7 | 4.9 | 10.5 | 127.9 | 153.5 | 9.0 | 15.0 | 44 | 6 | 40 |
| | A.C. | 35.1 | 7.0 | 10.5 | | ND | | | ND | | | ND | 26 | 38 |
| 2 | H.T. | 37.8 | 6.7 | 9.2 | 46.3 | 4.5 | 10.7 | 114.4 | 145.8 | 11.0 | 8.5 | 41 | 15 | 40 |
| | A.C. | 23.5 | 2.7 | 4.0 | | ND | | | ND | | | ND | ND | 37 |
| 3 | H.T. | 31.7 | 5.8 | 6.8 | 58.9 | 4.0 | 11.5 | 118.4 | 145.9 | 13.5 | 17.0 | 32 | 7 | 41 |
| | A.C. | 30.6 | 6.0 | 5.5 | | ND | | | ND | | | ND | 42 | 37 |
| 4 | H.T. | 32.6 | 8.0 | 12.3 | 54.0 | 5.8 | 9.8 | | ND | | | 45 | 6 | 41 |
| | A.C. | 17.1 | 3.6 | 3.2 | | ND | | | ND | | | ND | 31 | 37 |
| 5 | H.T. | 35.2 | 6.4 | 12.8 | 41.5 | 4.4 | 7.2 | 118.2 | 152.9 | 3.5 | 6.5 | 32 | 8 | 41 |
| | | | | | | | | | | | | | | 37A.C. |
| 6 | H.T. | 34.5 | 5.8 | 5.9 | 28.2 | 4.9 | 11.5 | 120.7 | 152.9 | 9.0 | 14.5 | 33 | 2 | 41 |
| | A.C. | | ND | | | ND | | | ND | | | ND | 20 | 38 |

Cond. = Condition
H.T. = Heat Treated 2 hours at 2050° F., Air Cool, 24 hours at 1550° F. Air Cool
ND = Not Determined
ksi = kips per square inch
El = Elongation (1¼ inch gage length)
RA = Reduction in Area
0.2% YS = Yield strength at 0.2% offset
UTS = Utimate Tensile Strength
Hard. = Rockwell C Hardness at Room Temperature
Average of five Impressions
Oxidation in air with 5% $H_2O$
Corrosion in JP-5 fuel with sulfur and chloride in burner rig combustion gas
$Mg/cm^2$ = Milligrams per square centimeter
mil = 0.001 inch The heat treated (H.T.) condition was obtained with a double heat treatment, from the as-cast condition, whereby ¼-inch diameter tensile test bars were heated in argon for 2 hours at 2050° F., air cooled (to room temperature in still air), reheated in air for 24 hours at 1550° F., and air-cooled.

The tests of resistance to corrosion in a jet propulsion combustion atmosphere environment were performed in a high temperature corrosion test facility of the kind referred to in the art as a "burner rig". Hot corrosion characteristics are considered important for gas turbine alloys even if the alloys are to be used with corrosion-resistant coatings, inasmuch as damage to the coating may expose the alloy to corrosive media. The PDMRL burner rig used for obtaining the test results of Table II is similar to the rig referred to in ASTM STP 421, 1967. For the present tests the burner rig exposed the specimens, mounted on a rotating platform in a furnace, to a controlled flow of hot combustion gas from a flame fed by fuel of a controlled composition, and cyclically removed the specimens from the furnace, air-cooled the specimens, and then returned the specimens into the furnace. Specimens were ⅛-inch diameter by 2-inch long pins with a 15 to 20 micro-inch surface finish. The fuel was a kerosene fuel known as JP-5 which, for the present tests, contained 0.3% sulfur. Air:fuel ratio was 30:1 by weight. Five ppm (parts per million by weight) sea salt was injected into the air for the flame. Total gas velocity was 25 feet per second. Furnace temperature was 1700° F. (927° C.). The heat/cool cycle was 58 minutes in the furnace and 2 minutes in an air blast directed at the specimens. The cycle was repeated hourly for a total of 168 hours. After the 168-hour cyclic exposure, the specimens (which had been measured and degreased in alcohol before the test) were cut at a point about one-half inch from the top of the specimen, and the one-half-inch portion of each specimen was mounted and polished for metallographic examination of the cross-section. After polishing, measurements were made to determine the maximum depth of penetration by corrosion attack, using the original dimensions as base lines.

Oxidation tests providing results in Table II were conducted in a flow of heated air to which a relatively large amount of water was introduced in order to accelerate oxidation. Air temperature was about 2000° F. (2012° F., 1100° C.). Atmospheric environment composition was air with 5% $H_2O$. Gas flow rate was controlled to be 250 cubic centimeters per minute, which provided a gas flow velocity of ½ centimeters per second. Exposures were in repeated cycles having 24 hours of exposure in each cycle, with cooling to room temperature (and weighing) following each cycle. Total high-temperature exposure time was 504 hours. Starting specimen form for each alloy was a 0.3-inch diameter, 0.75-inch long, cylinder having a centerless-ground 15 to 20 microinch surface finish. After the 21 cycles, without descaling between cycles, the specimens were descaled and weighed. Weight loss results in Table II are loss from start to finish of the total exposure time.

In view of Tables I and II, it is noted that desirable objectives of resistance to corrosion penetration greater than 20 mil in the 168-hour burner rig test, at least 30 hours stress-rupture life at 1800° F./2900 psi and at least 2% elongation at 1400° F., and good resistance to oxidation were attained and surpassed with embodiments of the alloy of the invention when in the microstructural condition resulting from the double heat treatment of 2 hours at 2050° F. plus 24 hours at 1550° F. Moreover, especially good resistance to corrosion by fuel combustion products was obtained from the alloys numbered 1 and 3 to 6.

The present invention is particularly applicable for providing cast articles to be used as rotor blades, stator vanes or other turbine components for fossil-fueled gas turbines, including aircraft, automotive, marine and stationary power plant turbines, and is generally applicable for heat and corrosion resistant structural and/or operational articles, e.g., braces, supports, studs, threaded connectors and grips, and other articles. When desired the alloy can be solidified as multiple grain or single grain castings with random, controlled or unidirectional solidification, and may be slow cooled, air cooled, quenched or chilled. Furthermore, if desired, the alloy may be produced as wrought or powder metallurgical products.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A nickel-base alloy consisting essentially of 11.5% to 16% chromium, up to 5% metal from the group tantalum and tungsten and mixtures thereof provided the amount of any tungsten does not exceed 3% and further provided the amounts of chromium and any tantalum and tungsten are in proportions in accordance with the relationship $$\%Cr+\tfrac{1}{3}(\%Ta+\%W) \text{ equal } 13.5\% \text{ to } 17.5\%,$$

4.3% to about 5% aluminum and 4% to about 5% titanium provided the sum of aluminum plus titanium is at least 8.5%, 2% to 4% molybdenum, up to 2% hafnium up to 10% cobalt, 0.08% to 0.2% carbon, up to 0.4% boron, up to 0.2% zirconium and balance essentially nickel.

2. An alloy as set forth in claim 1 containing at least 1.5% metal from the group tantalum and tungsten and mixtures thereof.

3. An alloy as set forth in claim 1 containing 13.5% to 15.5% chromium 4% to 7% cobalt.

4. A nickel-base alloy consisting essentially of 11.5% to 16% chromium, up to 5% metal from the group tantalum and tungsten and mixtures thereof provided the amount of any tungsten does not exceed 3% and further provided the amounts of chromium and any tantalum and tungsten are in proportions in accordance with the relationship:

$$\%Cr + \tfrac{1}{3}(\%Ta + \%W) \text{ equal } 13.5\% \text{ to } 17.5\%,$$

4.3% to about 5% aluminum and 4% to about 5% titanium provided the sum of aluminum plus titanium is at least 8.5%, 2% to 4% molybdenum, up to 2% hafnium, up to 10% cobalt, up to 0.2% carbon, 0.01% to 0.02% boron, up to 0.2% zirconium and balance essentially nickel.

5. A nickel-base alloy consisting essentially of 11.5% to 16% chromium, up to 5% metal from the group tantalum and tungsten and mixtures thereof provided the amount of any tungsten does not exceed 3% and further provided the amounts of chromium and any tantalum and tungsten are in proportions in accordance with the relationship:

$$\%Cr + \tfrac{1}{3}(\%Ta + \%W) \text{ equal } 13.5\% \text{ to } 17.5\%,$$

4.3% to about 5% aluminum and 4% to about 5% titanium provided the sum of aluminum plus titanium is at least 8.5%, 2% to 4% molybdenum, up to 2% hafnium, up to 10% cobalt, 0.02% to 0.2% carbon, 0.01% to 0.02% boron, 0.06% to 0.1% zirconium and balance essentially nickel.

* * * * *